US006848538B2

(12) United States Patent
Shafer

(10) Patent No.: US 6,848,538 B2
(45) Date of Patent: Feb. 1, 2005

(54) SUPPRESSOR FOR A PAINTBALL MARKER

(75) Inventor: Gordon Scott Shafer, P.O. Box 254, Briceville, TN (US) 37710

(73) Assignee: Gordon Scott Shafer, Briceville, TN (US)

( * ) Notice: Subject to any disclaimer, the term of this patent is extended or adjusted under 35 U.S.C. 154(b) by 97 days.

(21) Appl. No.: 10/383,807

(22) Filed: Mar. 8, 2003

(65) Prior Publication Data

US 2004/0173403 A1 Sep. 9, 2004

(51) Int. Cl.[7] ..... F41A 21/00
(52) U.S. Cl. ..... 181/223; 89/14.4
(58) Field of Search ..... 181/223; 89/14.4

(56) References Cited

U.S. PATENT DOCUMENTS

| | | | | |
|---|---|---|---|---|
| 984,890 A | | 2/1911 | Dudderar | |
| 1,127,250 A | | 2/1915 | Humm | |
| 2,043,731 A | | 6/1936 | Bourne | |
| 2,112,160 A | | 5/1938 | Hudson | |
| 2,150,161 A | | 5/1939 | Green | |
| 2,271,892 A | | 2/1942 | Bourne | |
| 2,351,037 A | | 6/1944 | Green | |
| 2,359,365 A | | 10/1944 | Katcher | |
| 2,448,382 A | | 8/1948 | Mason | |
| 2,448,593 A | | 9/1948 | Heising | |
| 2,451,514 A | | 10/1948 | Sieg | |
| 2,503,491 A | | 4/1950 | Janz | |
| 2,515,180 A | | 7/1950 | Barker | |
| 2,780,962 A | | 2/1957 | Fischer | |
| 2,883,781 A | | 4/1959 | Harvey | |
| 3,149,532 A | | 9/1964 | Pittaway | |
| 3,385,164 A | * | 5/1968 | Hubner et al. | 89/14.4 |
| 3,748,956 A | * | 7/1973 | Hubner | 89/14.4 |
| 3,786,895 A | * | 1/1974 | Perrine | 181/223 |
| 4,501,189 A | * | 2/1985 | Brandl et al. | 89/14.4 |
| 4,588,043 A | * | 5/1986 | Finn | 181/223 |
| 5,136,923 A | | 8/1992 | Walsh | |

FOREIGN PATENT DOCUMENTS

| | | |
|---|---|---|
| DE | 220470 | 4/1910 |
| DE | 2448865 | 4/1976 |
| FR | 401168 | 8/1909 |

OTHER PUBLICATIONS

"Silencer" Report R–1896 (Dept. of the Army) Frankford Arsonel , (Aug., 1968) pp. 19–29, 104–109.
"Schall Damper" Watten Journal, pp. 468–471.
"Acoustic Study Program—Phaze III" Final Report American Machine and Foundry Co., Paladin Press pp. 22–24, 54–55, 189–192.
"The Sielent War", U.S. Military Report Defence and Foreign Affairs(May,1982) pp. 24–25 and 29.
"Hear No Evil", Soldier of Fortune, (Aug., 1982) Truby and J. David, pp. 60–63.

* cited by examiner

*Primary Examiner*—Shih-Yung Hsieh

(57) ABSTRACT

An apparatus for suppressing muzzle pop and/or crack in a Paintball Marker, (also known as a Paintball gun), or other compressed gas gun with an outer shell which connects to a proximal end cap with centered opening to be secured to a muzzle of a Paintball marker by an attachment piece, and a distal end cap with an centered exit opening. An internal structure that is centered along the longitudinal firing axis of the apparatus, between the proximal end cap and distal end cap, and being the bore for the proximal end opening for accepting the paintball marker barrel, and the distal exit opening in the center of the distal end cap for the exiting Paintball. The attachment piece and internal structure will accept a wide range of production paintball barrel diameters, as well as be self centering and aligning along the longitudinal firing axis of the apparatus.

11 Claims, 1 Drawing Sheet

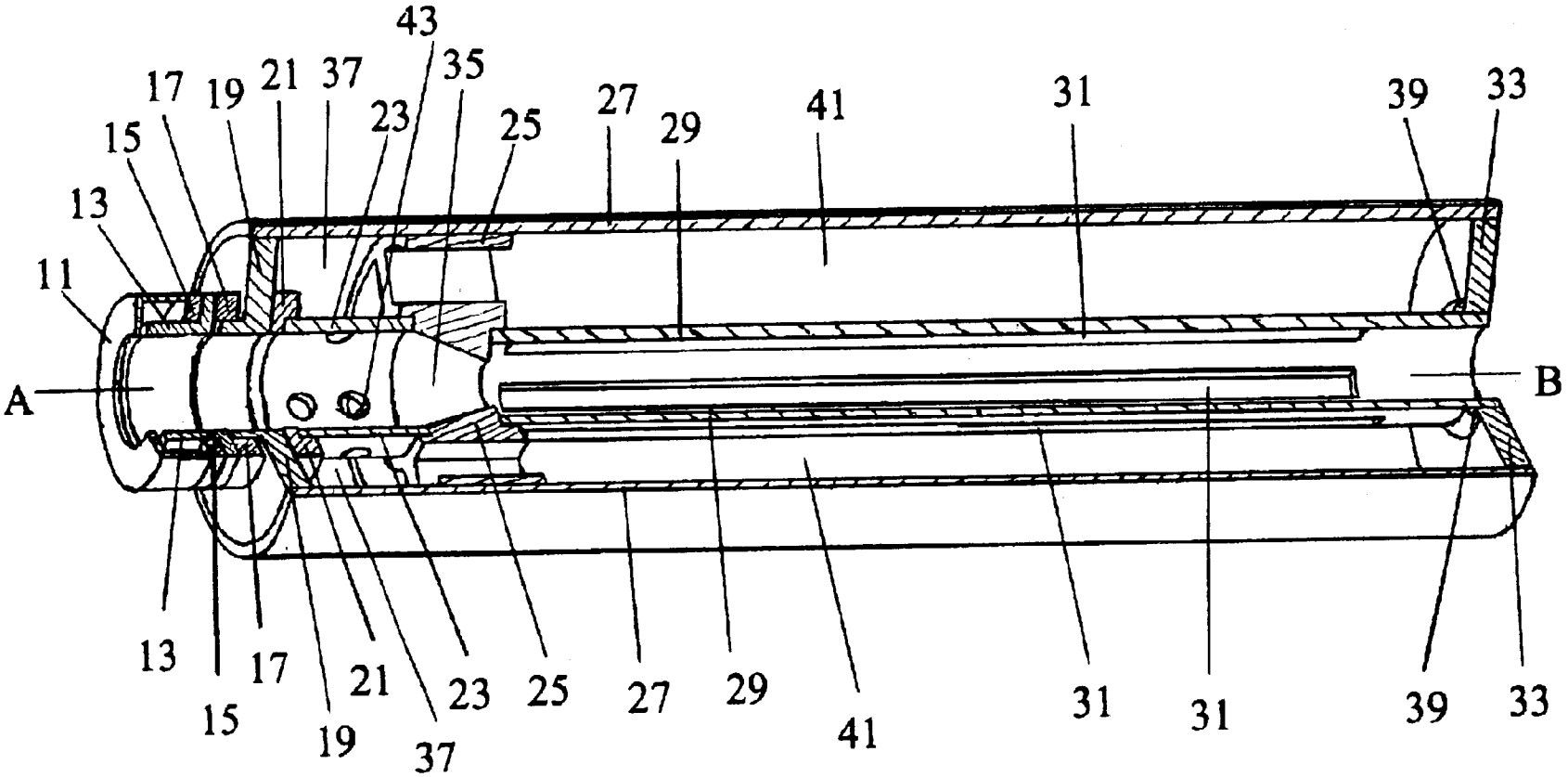
B
33
39
31
41
29
27
25
35
43
23
37
21
19
17
15
13
11
A

SUPPRESSOR FOR A PAINTBALL MARKER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of Silencers or Suppressors and more specifically to A Suppressor for a Paintball Marker. More specifically this invention relates to a suppressor that adapts to a range of Paintball barrel diameters and at the same time self aligns and self centers itself along the axis of the bore of the Paintball Marker barrel and the bore of the Suppressor.

The terms used below, such as proximal and distal, relate to the firing direction as well as the end closest and furthermost from the firer with arm out stretched shooting at a target away form his body. Proximal refers to the end of the Suppressor that attaches to the end of the barrel and distal refers to the end of the suppressor furthermost away, the part where the paintball exits after being fired.

The invention relates to an apparatus for suppressing muzzle pop and/or crack in a Paintball Marker, (also known as a Paintball gun), or other compressed gas gun.

Further, the present invention is a apparatus that self adapts itself to a wide range of paintball barrel diameters.

Still a further additional object of the present invention is a apparatus that also self centers and aligns itself to the firing axis.

The technology of Silencers, Suppressors, or Mufflers for Fire Arms are well known. A silencer contemporary, customary is known from U.S. Pat. No. 3,385,164 (Walther), and the extensive works by Maxwell. All of these devices address reducing the sound output of a true Firearm, and are specifically made for the caliber of the projectile, diameter of the barrel, and type of weapon it is attached to.

The sport of Paintball has been around since the late 80's. A Paintball Marker also sometimes called a Paintball Gun is a compressed air powered "Gun", that shoots a 0.68 cal. gelatin shelled ball of paint, that shoots out of the end of the barrel at any where from 250 ft/sec to 300 ft/sec, practical useable range is 1--150 ft. The object is to shoot the opposing players on the other side and pop a ball of paint on an opposing player there by marking them, were upon the are considered out of the game. Most commonly, The winning team is the one that still has at least one player in the game after the other team members are marked as out or "Eliminated", very similar to the game of "Tag" but played at range. There are many ways of playing Paintball some examples are: Woods ball, Speed ball, and Scenario Games.

There are no commercial Paintball Suppressors currently on the market, mostly due to the in-depth regulations, money and requirements that the BATF, (Bureau of Alcohol Tobacco and Firearms), requires to own, build or manufacture silencers. The BATF considers silencers for Paintball markers as Suppressor just like the ones for true Fire Arms, since a Paintball Marker is a projectile device similar in function and action like a true Fire Ann. There is a large demand for suppressors from mostly the Woods and Scenario Game players, since both of these types of players like to sneak up on other players to mark them with paint Unfortunately due to the short distances involved to shoot at each other with paintballs, which is usually anywhere from 30 feet to 150 feet. This is a very short distance, if you are trying to pick off players from a hidden position, the loud "Pop" of the Paintball marker will quickly let opposing players zero in on your location and mark you and put you out of the game.

Currently all commercial Suppressors are made for true Fire arms Even though the caliber of a Paintball is 0.68, the O.D. diameters of the barrels very greatly, usually typical commercial diameters range from roughly 0.75 inches to a little under 1.0 inches.

None of the current Suppressor, (also called Silencer), patents have the ability to adapt to a variable range of barrel diameters.

Further, none of the current Silencers are self aligning and centering along the firing axis of a projectile device across a variable range of barrel diameters.

BRIEF SUMMARY OF THE INVENTION

The primary object of the invention is to provide a Suppressor to quite the loud Pop of Paintball Markers on firing a paintball, so as not to give away your position in a game.

Another object of the invention is to provide a Paintball Suppressor that is self adapting to a range of variable diameter Paintball Marker barrels.

Another object of the invention is to provide a Paintball Suppressor that is self centering along the long axis of variable diameter Paintball Marker barrels.

A further object of the invention is to provide a Paintball Suppressor that is easily disassembled for cleaning out paint that may have busted in the Suppressor.

Yet another object of the invention is to provide an coupling mechanism that adapts to Paintball barrels but is difficult to adapt to standard firearms.

Still yet another object of the invention is to provide a Suppressor coupling mechanism that quickly disconnects to dean broken paint from the markers barrel.

Another object of the invention is to provide a Suppressor coupling mechanism, constructed in such a manner, that doesn't scratch the paint or mar the surface of the markers barrel.

Another object of the invention is to provide acoustic materials in the Suppressor that function well for a Paintball Marker, but will melt and fail to function if used with a real firearm.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus for muzzle pop and/or crack in a Panitball Maker, (also known as a Paintball gun), or other compressed gas gun comprising: An outer shell, A proximal end cap with centered opening to be secured to a muzzle of a Paintball marker by an attachment piece, that will attach to a range of Paintball Marker barrel diameters, and including provisions for coupling to the proximal end of said outer shell, A distal end cap with a centered exit opening aligned with said proximal end cap centered opening, along the longitudinal axis which is also the axis of fire that a Paintball travels after discharge, and including provisions for coupling to the distal end of said outer shell, An internal structure comprising: A proximal inner tube centered along the long axis of the apparatus, with holes drilled in it along its longitudinal length about the four cardinal directions, that is of large enough inner diameter to accommodate the largest outside diameter, of production Paintball barrels, has a thin wall, and a outside diameter that allows it to fit easily inside said outer shell with room to spare, A distal inner tube centered along the long axis of the apparatus, with slots machined in it, stopping short of the ends, along its longitudinal length about the four cardinal directions, that is of large enough inner diameter to give marginal clearance to a Paintball as not to touch it, but small enough to allow air pressure to vent out the slots as opposed to escaping around the Paintball, has a thin wall, and a outside diameter that allows it to fit easily inside said outer shell with room to spare, An internal disk shaped piece, that self centers and aligns the bore of the suppressor with that of variable diameter Paintball Marker barrels, along the axis of the Paintball firing trajectory, comprising: An internal disk shaped piece, about 1" thick, extending from its center to said outer shell, with a conically shaped hole longitudinally placed in the center, the largest diameter of the center cone is toward the proximal end, and is slightly larger than the largest diameter Paintball barrel which is about 1", but yet inset and marginally smaller than the outside diameter of the distal end of said proximal inner tube, in which it connects, the narrowest diameter of the cone is 0.72" toward the distal end, along the line of fire of a Paintball projectile, and connects with proximal end of said distal inner tube, said internal disk also has slots drilled at its periphery, close to the outer shell spaced equally apart in a radial pattern and they do not cross the borders of the center conical shape or touch the inner wall of said outer shell, A said proximal inner tube and a said distal inner tube with a said internal disk shaped piece between them disposed between said proximal end cap and said distal end cap, that creates two internal chambers, one proximal chamber on the proximal end of the apparatus, centered around the said proximal inner tube and bordered by said proximal end cap and proximal face of said internal disk, and one distal chamber on the distal end of the apparatus, centered around said distal inner tube, bordered by said distal end cap and the distal face of said internal disk, and an acoustical element to fill in the area created by the two said internal proximal and said distal chambers, not limited to, but comprised of: A empty space in said chambers filled by the native air, synthetic sponge or foam, plastic polymer, synthetic rubber, or synthetic mesh baffles, or a combination of some, all, or none of the above mentioned said: native air, synthetic sponge or foam, plastic polymer, synthetic rubber, or synthetic mesh.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

The singular FIGURE of the suppressor embodying the present invention, as drawn, is a three dimensional perspective view, with a sectional cut away for view of the internal parts and there relationship to each other.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Turning now to the drawings, in which like reference characters indicate corresponding elements throughout the drawing. With reference to the drawing, of a singular, 3D, perspective drawing with longitudinal cut away. The apparatus, here after to be called a Suppressor, for suppressing muzzle pop and/or crack from a paintball marker. The Paintball Marker, (also known as a Paintball Gan), or other compressed gas gun, which from here after will be known as a Marker. According to the FIGURE, the Suppressor is comprised of three main elements, i.e., an attachment piece comprised of 11, 13, 15 and 17, the Internal centering and aliening piece comprised of 25 and 35, the remaining suppressor body composed of 19, 21, 23, 27, 29, 31, 33, 37, 39, 41, and 43. Reference letters A and B denotes direction of the paintball's trajectory after firing, wherein the ball travels along the center longitudinal axis along the center bore, and moves from letter A to letter B. Also reference letter A denotes the proximal end of the suppressor, the end closest to the marker and the person firing the marker with the arm held out in extension parallel to the ground, towards a target in front of the firers body. Reference letter A also denotes the point where the suppressor attaches to the distal end of the marker, the marker barrel is inserted into the proximal center bore until, according to its diameter, it comes to rest at some point along the centering/aligning cone 35, inside of piece 25. Reference letter B denotes the center bore at the distal end of the suppressor where the paintball exits after being fired.

All known current commercial suppressors or silencers are made for true Fire Arms, i.e. pistols, rifles and other small arms.

Those same suppressors are designed to work with a very specific caliber of weapon and often also made for a particular make of weapon, it is noted that the above mentioned suppressors work only for a very limited caliber, type of weapon and barrel type.

One of the advantages of the present invention is that it adapts to Paintball Marker barrels, Paintball being considered a sport and Paintball markers being considered a piece of athletic equipment. The Paintball Markers barrel diameter can be of a range from ¾ inch to 1 inch in outside diameter. Further, the present invention will also self center and align itself with the center longitudinal bore of the Paintball marker, so that when a Paintball is fired it will travel down the central longitudinal bore of the suppressor without touching the walls of the inner tubes.

Turning now to the attachment assembly comprised of the Attachment assembly cover piece 11, Rubber attachment piece 13, compression plate 15 for Rubber attachment piece 13, and Attachment piece to suppressor female coupling piece 17. Pieces 11, 15, 17 are machined from Aluminum or other suitable material connect to each other in the following order. Piece 13 which is a modified 1" to 2" or 3" Rubber plumbing pipe reducer, is sandwiched between pieces 15 and 17 with the 1" pipe reducer clamping end oriented proximally and a hose clamp or similar device is used to tighten down the 1" pipe reducer end to where it securely grips the Paintball barrel, since the clamping force is evenly distributed around the Rubber pipe reducer, this also "Centers" the Attachment elements to where it is centered in relation to the center longitudinal axis of the Paintball barrel. The internal bore of the attachment elements is of large enough diameter to accept up to a 1" diameter Paintball Barrel.

Further, the Rubber Attachment piece 13, (the modified pipe reducer), while maintaining a secure attachment to the Barrel won't mar or damage the Paintball barrel in any way. The Attachment assembly cover piece 11, is a cosmetic piece to cover the hose clamp and Rubber Attachment piece 13, and to make the look of the suppressor more symmetrical and professional looking. Piece 17 is female threaded on its I.D. to allow the rest of the suppressor to be screwed into piece 17, by the Male threads on the coupling piece that is made onto the Proximal End Cap 19.

The second element of the present invention is the Internal centering and aliening piece comprised of parts 25 and 35, this patently important piece is machined from Delrin, its outer most diameter is such that it just fits inside the I.D. of the outer shell 27. Further, it is disk shaped about 1" thick, its primary feature is the Cone shaped bore 35, at its longitudinal center with the broad base of the cone oriented proximally and the smaller base of the cone oriented distally. The proximal cone base is 1" and the distal cone base is 0.72", this is designed in such a way that when a Paintball Barrel is inserted into the proximal end of the suppressor in its central bore A, the distal tip comes to rest at some point along the slope of the walls of the central cone, where it comes to rest will depend upon the O.D. of the Barrel, the smaller diameter the barrel the further into the cone towards the distal end of the suppressor it will come to rest. The distal cone base is 0.72" which is smaller than any of the current commercial Paintball Barrels, but yet still larger than the largest paintball. Another of its features is that since the barrels are round and the cone is round when the barrel comes to rest, this also centers and aliens the suppressors central bore with that of the Paintball Barrel. Further, it has four slots set in a radial pattern, separated by ¼" struts, cut between the central cone 35, inset seats for the Proximal Inner Tube 23, and Distal Inner Tube 29, and the Outer shell 27, the slots extend to within ⅛" of the outer shell 27. There is no communication between the four slots and the central cone 35, inset seats for the Proximal Inner Tube 23, and Distal Inner Tube 29. The four slots do allow communication between the Proximal Expansion Chamber 37, and the Distal Expansion Chamber 41. It is also a feature of the present invention that Delrin is considered a bearing material and will not mar or damage the distal tip of the Paintball barrel in any way.

The third grouping of elements of the present invention is the remaining suppressor body. This is comprised of the Proximal End Cap with male threaded coupling piece 19, Proximal Inner Tube Seat 21, Proximal Inner Tube 23, Outer Shell 27, Distal Inner Tube 29, Slot Vents 31, Distal End Cap 33, Proximal Expansion Chamber 37, Weld or Press fit attachment point 39, to attach the Distal Inner Tube 29 to the Distal End Cap 33, Distal Expansion Chamber 41, Port vents 43. Starting with the Outer shell 27 which is 3" in O.D. and 2.75" I.D. and 12" long, made of a machinable material for example Aluminum, that company logo, manufactures address, model number, and serial number can be indelibly stamped into its outer surface as required by the BATF, (Bureau Alcohol Tobacco and Firearms). At the proximal end of piece 27, the Proximal End Cap 19, will be fitted inside piece 27. The Proximal End Cap 19 is ¼" thick and 2.75" in diameter, machined to have a male threaded shoulder piece oriented toward the proximal direction which will allow the suppressor to be coupled to the Attachment assembly, this piece also has a central bore of 1". Piece 19 may also as a alternative have holes drilled in a radial pattern close to the periphery to allow gas venting out the proximal end of the suppressor as a way to reduce internal pressure and help reduce the amount of gas escaping the distal end, thus reducing the forward shock wave and decreasing forward sound signature On the distal surface of piece 19, provision is made to mount the Proximal Inner Tube Seat 21 to the distal face of piece 19, piece 21 is orientated with the inset for the seating of the Proximal Inner tube 23, oriented distally, its central bore is 1". The Proximal Inner Tube 23, is 125" O.D. and 1" I.D. and has ¼" Port Vents 43, spaced in the four cardinal directions 90 degrees angulation from each other, and the north-south Port Vents are ¼' out of step with the east-west Port Vents. The north-south Port Vents are directly across from each other, and the east west Port Vents are across from each other, the vents pass through any gas to the Proximal Expansion Chamber 37 that escapes from ported commercial barrels. The distal end of piece 23 is seated into the proximal center face of piece 25 and the internal bore of piece 23 butts up directly to the proximal cone base of part 35, and is centered along with part 35, in line with the longitudinal firing axis. The Distal Inner Tube Piece 29, has its proximal end that seats into the distal center face of piece 25, the smaller base of the cone part 35 abuts the proximal end of Piece 29, and this small diameter opening is centered to be along the center longitudinal firing axis and centered also along the same axis as piece 29. Piece 29, has four longitudinal Slot Vents 31, that are ¼" wide, the Slot Vents 31 are cut in the four cardinal directions at 90 degrees to each other and extend almost the full length of piece 29, they stop 1" short of its distal end so that it is easier for the propelling gas to escape into the Distal Expansion Chamber 41, at the proximal end they are ⅛" shy of the proximal end of piece 29, piece 29 has a 1" O.D. and 0.75" I.D. Piece 29 is fitted into the central bore of the Distal End Cap 33, and is held in connection with it by piece 39, which is a weld or press fit, so that pieces 29, and 33 become as one complete piece, that can be removed as a unit for cleaning. Piece 33 is 2.75" O.D. and ¼" thick, and fits inside the distal end of piece 27, it also has a central bore to accommodate the outer diameter of piece 29, the central bore is centered, like all other central bore pieces, along the longitudinal firing axis of the Paintball barrel.

The use and operation of the present invention is quite simple, the distal end of a Paintball Barrel is inserted into the proximal central bore of the Suppressor until depending upon the outside diameter of the Barrel, it will come to rest in a centered and aliened position in the cone 35 in the center of piece 25. Once the barrel comes to rest, the Adapter assembly is screwed about half way onto the suppressor body then a hose clamp, (not shown), or other concentric tightening device, is tightened on the Rubber attachment piece 13, and in so doing secure the suppressor to the distal end of the Paintball Barrel. This action will also center and alien the Proximal end of the suppressor, (including all parts of the attachment assembly), along the longitudinal firing axis of the Paintball Barrel, for cosmetic purposes, (to hide the hose clamp), the Attachment Assembly Cover Piece 11, is then bolted onto the rest of the Assembly unit. As a final step, the suppressor is tightened, by screwing together the Attachment Assembly and Suppressor body, by the 2–3 finger tight method so as not to over tighten and possibly damage the threads, Attachment Assembly, or the Centering and Aligning Piece. Once the present invention is secured to the Paintball Barrel, and a paintball is fired, the Paintball exits the distal end of the Paintball Barrel, the air escaping behind the ball, as well as any air that may escape from any porting on a Barrel if it has ports will be allowed to pass through the ¼" port holes of piece 23, and out into the Proximal Expansion Chamber 37, gas escaping from the distal end of the Paintball Barrel, which by far is the greater volume, will be allowed to escape through the ¼' Slot Vents 31, that are cut into the Distal Inner Tube 29, and into the Distal Expansion Chamber 41. In piece 29 it is noted that the last 1" of the distal end does not have Slot Vents 31 in it That is so that do to the close tolerance of the Inner diameter of the Distal Inner Tube 29 which is 0.75" and the diameter of the average Paintball is 0.68" it is easier for the expanding gas to escape through the Slot Vents 31 and into the Distal Expansion Chamber 41, than to try to get through the much tighter clearance around the Paintball Some of the Escaping gas will still exit with the Paintball but a much larger volume will be trapped in the Suppressor body, thus greatly reducing the sound of a fired Paintball.

The Proximal and Distal Expansion Chambers, 37 and 41 respectively may also be filled with an acoustical element which may be comprised of, but not limited to the following: A empty space filled by native air, synthetic sponge or foam, plastic polymer, synthetic rubber, synthetic mesh baffles, or a combination of some, all, or none of the above mentioned items. No acoustical material would equal native air.

The Materials and tolerances are made for a Paintball gun or compressed air gun that works well for the low pressures and heat of Paintball gases, but would fail under the much greater pressures and temperatures of a true firearm, this would done on purpose so that it would be easier and cheaper for a person to either buy a commercial suppressor for a firearm or make a new one from scratch as opposed to the extensive and expensive reworking and machining that would be required to adapt this to a real firearm. It is intended to be used as a Accessory piece of equipment for a piece of athletic equipment known as a Paintball Marker or also known as a Paintball Gun. Another consideration for the present invention is that all screws used through out the suppressor are of the same diameter and drive type for example Allen head sockets, so that it takes only one size of Allen wrench to disassemble the suppressor to its component parts, further the Outer shell 27 as well as all visibly external pieces, (except the Rubber attachment piece 13), are made of a material like Aluminum or other material that can be marked with the above indelible information as well as accept a wide variety of finishes for those who would like to match the color of the marker it is attached to.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for suppressing muzzle pop and/or crack in a paintball marker, also known as a paintball gun, or other compressed gas gun comprising:

an outer shell;

a proximal end cap with centered opening to be secured to a muzzle of a paintball marker by an attachment piece and including provisions for coupling to the proximal end of said outer shell;

a distal end cap with a centered exit opening aligned with said proximal end cap centered opening, along the longitudinal axis which is also the axis of fire that a paintball travels after discharge, and including provisions for coupling to the distal end of said outer shell;

an internal structure comprising:

a proximal inner tube centered along the long axis of said internal structure, with holes drilled in it along its longitudinal length about the four cardinal directions, that is of large enough inner diameter to accommodate the largest outside diameter, of production paintball barrels, has a thin wall, and a outside diameter that allows it to fit easily inside said outer shell with room to spare;

a distal inner tube centered along the long axis of said internal structure, with slots machined in it, stopping short of the ends, along its longitudinal length about the four cardinal directions, that is of large enough inner diameter to give marginal clearance to a paintball as not to touch it but small enough to allow air pressure to vent out the slots as opposed to escaping around the paintball, has a thin wall, and a outside diameter that allows it to fit easily inside said outer shell with room to spare;

an internal disk shaped piece comprising:

an internal disk shaped piece, about 1" thick, extending from its center to said outer shell, with a conically shaped hole longitudinally placed in the center, the largest diameter of said conically shaped hole is toward the proximal end, and is slightly larger than the largest diameter paintball marker barrel which is about 1", but yet inset and marginally smaller that the outside diameter of the distal end of said proximal inner tube, in which it connects, the narrowest diameter of the cone is 0.72"toward the distal end, along the line of fire of a paintball projectile, and connects with the proximal end of said distal inner tube, said internal disk also has holes drilled at its periphery, close to the outer shell spaced equally apart in a radial pattern and they do not cross the borders of the center conically shaped hole or touch the inner wall of said outer shell:

said proximal inner tube and a said distal inner tube with said internal disk shaped piece between them disposed between said proximal end cap and said distal end cap, that creates two internal chambers, one proximal chamber on the proximal end of said internal structure, centered around said proximal inner tube and bordered by said proximal end cap and proximal face of said internal disk; and one distal chamber on the distal end of said internal structure, centered around said distal inner tube, bordered by said distal end cap and the distal face of said internal disk; and an acoustical element to fill in the area created by said internal proximal and said distal chambers, comprised of:

a empty space in said chambers filled by native air;

a synthetic sponge or foam;

a plastic polymer, synthetic rubber, or synthetic mesh baffles; or a combination of some, all, or none of the above mentioned said: native air, synthetic sponge or foam, plastic polymer, synthetic rubber, or synthetic mesh.

2. An apparatus for suppressing muzzle pop and/or crack in a paintball marker, also known as a paintball gun, or other compressed gas gun as claimed in claim 1 wherein said attachment piece, allows quick attachment and detachment of said apparatus, but does not damage the surface of the marker barrel.

3. An apparatus for suppressing muzzle pop and/or crack in a paintball marker, also known as a paintball gun, or other compressed gas gun as claimed in claim 1 wherein said conically shaped hole is sized to accept a variable range of diameters of paintball barrels.

4. An apparatus for suppressing muzzle pop and/or crack in a paintball marker, also known as a paintball gun, or other compressed gas gun as claimed in claim 1 wherein said internal disk shaped piece is made in such a way that by sliding a paintball marker barrel into it, said conically shaped hole automatically centers said apparatus along the firing axis, and the distal most end of said paintball marker barrel will come to rest where its outside diameter matches the inside diameter of said conically shaped hole, since said conically shaped hole continues to get smaller and said paintball marker barrel does not, it will come to a rest, and since said paintball marker barrel is round and so is said conically shaped hole, said conically shaped hole will also center said paintball marker barrel along the firing axis.

5. An apparatus for suppressing muzzle pop and/or crack in a paintball marker, also known as a paintball gun, or other compressed gas gun as claimed in claim 1 wherein said conically shaped hole is of a material that does not damage the surface of the muzzle of the barrel.

6. An apparatus for suppressing muzzle pop and/or crack in a paintball marker, also known as a paintball gun, or other compressed gas gun as claimed in claim 1 wherein said internal disk is made to allow air flow communication between said proximal and said distal chambers of the apparatus.

7. An apparatus for suppressing muzzle pop and/or crack in a paintball marker, also known as a paintball gun, or other compressed gas gun as claimed in claim 1 wherein said attachment piece that accepts a variable range of diameters, of said paintball marker barrels, equal in diameter to those that are accepted by said conically shaped hole, and still maintain a good secure attachment to the paintball marker barrel.

8. An apparatus for suppressing muzzle pop and/or crack in a paintball marker, also known as a paintball gun, or other compressed gas gun as claimed in claim 1 further comprising an acoustical element that reduces the decibel output and occupy said proximal and said distal chamber spaces of the apparatus.

9. An apparatus for suppressing muzzle pop and/or crack in a paintball marker, also known as a paintball gun, or other compressed gas gun as claimed in claim 1 wherein said acoustical element comprising:

an acoustical element which works well with paintball markers, but melts and fails to function when used with a real fire arm;

an acoustical element made of a material or materials that are washable with water to remove paint residue from broken paintballs with out damage;

an acoustical element, for example comprised of:

a empty space in said chambers filled by the native air;

a synthetic sponge or foam;

a plastic polymer, synthetic rubber, or synthetic mesh baffles;

a combination of some, all, or none of the above mentioned said: native air, synthetic sponge of foam, plastic polymer, synthetic rubber, or synthetic mesh.

10. An apparatus for suppressing muzzle pop and/or crack in a paintball marker, also known as a paintball gun, or other compressed gas gun as claimed in claim 1 wherein said apparatus is made to function properly with a paintball marker, and difficult, time consuming, expensive, and require a complete reworking of said adapter piece, said internal structure, and said acoustical element, to function on a true firearm.

11. An apparatus for suppressing muzzle pop and/or crack in a paintball marker also known as a paintball gun, or other compressed gas gun as claimed in claim 1 wherein said apparatus is to be also known as a suppressor, comprises:

said outer shell made of aluminum, or other metal, that a serial number, manufacturers address, and phone number can be stamped in a indelible manner, as required by the bureau of alcohol tobacco and firearms;

said suppressor assembled in such a way that only hands or one tool is required to disassemble it for detail cleaning;

said outer shell, said end pieces, and said attachment piece made of a aluminum or other metal that many types of finishes are available.

* * * * *